US005310091A

United States Patent [19]

Dunning et al.

[11] Patent Number: 5,310,091

[45] Date of Patent: May 10, 1994

[54] DUAL PRODUCT DISPENSER

[75] Inventors: Walter B. Dunning, Sonora, Calif.; Robert L. Bundschuh, Miami Lakes, Fla.

[73] Assignee: Tremco, Inc., Beachwood, Ohio

[21] Appl. No.: 60,894

[22] Filed: May 12, 1993

[51] Int. Cl.[5] ..... B67D 5/42

[52] U.S. Cl. ..... 222/135; 222/145; 222/327; 222/386

[58] Field of Search ..... 222/94, 129, 135, 136, 222/137, 145, 326, 327, 319, 320, 386

[56] References Cited

U.S. PATENT DOCUMENTS

| | | | |
|---|---|---|---|
| 1,950,137 | 3/1934 | Dowe | 222/135 X |
| 2,001,819 | 5/1935 | Elle et al. | 222/162 X |
| 3,144,966 | 8/1964 | Cook | 222/137 X |
| 3,164,303 | 1/1965 | Trautmann | 222/190 |
| 3,437,242 | 4/1969 | Poitras | 222/135 |
| 4,014,463 | 3/1977 | Hermann | 222/145 |
| 4,029,236 | 6/1977 | Carson et al. | 222/135 |
| 4,050,612 | 9/1977 | Stone | 222/135 |
| 4,205,766 | 6/1980 | White | 222/135 |
| 4,220,261 | 9/1980 | White | 222/135 |
| 4,340,154 | 7/1982 | VanManen | 222/94 |
| 4,366,919 | 1/1983 | Anderson | 222/137 |
| 4,371,094 | 2/1983 | Hutter, III | 222/136 X |
| 4,676,406 | 6/1987 | Frischmann | 222/135 X |
| 4,771,919 | 9/1988 | Ernst | 222/145 X |
| 4,799,801 | 1/1989 | Bruning | 366/255 |
| 4,826,047 | 5/1989 | Heflin | 222/136 |
| 4,834,714 | 5/1989 | Lascar et al. | 222/135 X |
| 4,961,520 | 10/1990 | White | 222/135 |
| 4,969,747 | 11/1990 | Colin et al. | 222/137 X |
| 5,065,906 | 11/1991 | Maeder | 222/137 |
| 5,139,171 | 8/1992 | Mader | 222/137 |

*Primary Examiner*—Kevin P. Shaver

*Attorney, Agent, or Firm*—Michael Sand; David P. Dureska

[57] ABSTRACT

A dispenser for simultaneously dispensing and mixing a pair of fluid products such as chemically reactive resins, from a pair of axial adjacent front and rear chambers. A piston is mounted within each of the chambers and is moveable with respect to the hollow interior of the respective chamber for dispensing the fluid product therefrom. Telescopic movement of the rear chamber within the front chamber moves the pistons synchronously through the chambers to provide for controlled discharge of the products through a front discharge nozzle. A fixed hollow delivery tube extends through the interior of the front chamber and telescopically receives therein a post which is mounted on a rear wall of the rear chamber. The rear chamber has a relatively tight sliding fit within the front chamber so that a partial vacuum is formed within an annular space which forms between the two pistons as they move apart upon discharge of the two products to produce a "suck back" effect on product remaining in the discharge nozzle.

13 Claims, 3 Drawing Sheets

DUAL PRODUCT DISPENSER

BACKGROUND OF THE INVENTION

1. Technical Field

The invention relates to dispensing a plurality of fluid materials, which when mixed together chemically react to produce a desired end product such as an adhesive, potting compound, sealer, encapsulant or the like. More particularly, the invention relates to a dispenser for dispensing two fluid products in preset amounts, which products are maintained separate until they are mixed prior to being discharged from the dispenser through a nozzle.

2. Background Information

Various types of dispensers have been developed for dispensing a plurality of fluid materials such as chemically reactive resins, or a resin and a hardener, which products must be maintained out of contact with each other within the dispenser so that when mixed, they chemically react to form a final product. It is desirable that the dispenser dispenses the two products in a preset accurately controlled relationship to ensure that the proper chemical reaction takes place when forming the final product, since the final product can be greatly affected by an unbalanced ratio of the two component products.

It is desirable for many applications that the dispenser be a relatively simple and inexpensive device, which preferably can be discarded after discharge of the two components, thereby making it suitable for jobshops, residential users, and the like. Therefore, when intended for use in such applications, the user will normally be unskilled in the dispensing art and will not be concerned with or about, nor experienced in the correct mixing of the two components in forming the final product. Therefore, it is necessary that upon operation of the dispenser, the two products are mixed in the desired relationship without requiring any skill on the part of the dispenser operator.

Examples of the most pertinent prior art dispensers with respect to the dispenser of the present invention are shown in the following patents.

U.S. Pat. No. 4,014,463 discloses a dual component dispenser which uses a hollow delivery tube which extends through a flexible sealing disc at the forward end so that the discharged contents from one of the chambers mixes with the second product discharged from the second chamber at a static mixer nozzle.

U.S. Pat. No. 4,050,612 discloses a dispenser containing two different materials such as creams, wherein an upper chamber is telescopically slidably mounted and moved into a lower chamber for simultaneously discharging products from each of the containers at a pair of adjacent openings.

U.S. Pat. No. 4,029,236 discloses another two product dispenser having an upper chamber which is telescopically moved over and downwardly along a second chamber whereupon the contents of the two chambers are dispensed, generally simultaneously through two separate dispensing tubes. A vent tube is provided in the dispenser to prevent the formation of a vacuum within the dispenser upon dispensing of the product to ensure the smooth movement of the two chambers with respect to each other.

U.S. Pat. No. 4,220,261 discloses another dual dispenser in which an air intake is provided in a dispensing tube, as well as an annular air space being provided between the walls of the two cylindrical chambers, to prevent the formation of a vacuum therebetween during operation of the dispenser.

U.S. Pat. No. 4,961,520 discloses another dual product dispenser whereby a free space is provided so that a second plunger is actuated only after a predetermined movement of another plunger in order to prime the dispenser and prevent premature discharge of the flowable product from within a plunger cup.

Although the above discussed patents are believed to be the most pertinent with respect to the present invention, still other examples of various product dispensers are shown in U.S. Pat. Nos. 2,001,819, 3,164,303, 4,366,919, 4,371,094, 4,676,657, 4,691,845, 4,735,509, 4,799,801, 4,826,047, 4,834,714, 4,941,751, 5,058,770, 5,065,906 and 5,139,171.

Although many of these prior art dual product dispensers perform satisfactory for their intended dispensing purpose, many of these dispensers are difficult to easily fill the two separate chambers with the two distinct products, while maintaining complete separation of two products from each other. Likewise, certain of these prior art dispensers are relatively expensive, especially when the dispenser is intended to be mass produced in large quantities. Thus a savings of only a few cents per dispenser over similar prior art dispensers will result in a cost savings and competitive advantage.

SUMMARY OF THE INVENTION

Objectives of the invention include providing an improved dual product dispenser which increases the effectiveness and ease of filling a pair of chambers with two separate chemically active products and subsequently discharging the two products in a predetermined relationship generally simultaneously, for subsequent joining and mixing in a discharge nozzle, in a simple and inexpensive device.

A further objective of the invention is to provide such a dispenser in which a single force when applied on one of the chambers will synchronously dispense the two flowable products from their respective chambers in the desired amounts, whereupon the products are joined, preferably at the inlet end of a static mixer nozzle which is attached to the dispenser.

A still further objective is to provide such a product dispenser which creates a partial vacuum between a pair of pistons within the dispenser when dispensing the two products therefrom, in order to provide a "suck back" feature upon stopping of the applied dispensing force, to reduce dripping and unwanted discharge of the product remaining in the discharge nozzle.

Another objective is to provide such a dispenser which contains an elongated post which extends into a delivery tube located within the dispenser in order to eliminate most of the free volume inside one of the chambers at the start of filling the chambers with products enabling the chambers to be pressure filled generally simultaneously without worrying about any residual pressure due to air compression within the free volume of one of the chambers.

Another objective is to provide such a dual dispenser which uses such an elongated post in order to reduce the amount of product left in the dispenser after the discharge pistons have reached their maximum limit, thereby reducing the cost of the dispenser product.

These objectives and advantages are obtained by the dual product dispenser of the invention, the general nature of which may be stated as including first and second chambers having hollow interiors, each of said chambers having a piston for discharging a first and a second product respectively, from the interiors of said chambers; said second chamber being slidably mounted within the interior of the first chamber wherein movement of the second chamber effects synchronous movement of both pistons with respect to their respective chambers for discharging the products therefrom; each of said chambers having an exit port through which the respective products are discharged upon movement of the second chamber into the first chamber; a product delivery tube extending through the interior of the first chamber, said delivery tube having a first open end communicating with the interior of the second chamber and a second open end providing the exit port for said second chamber; and an elongated post mounted on the second chamber moveable into the delivery tube of the first chamber upon movement of the second chamber into said first chamber.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
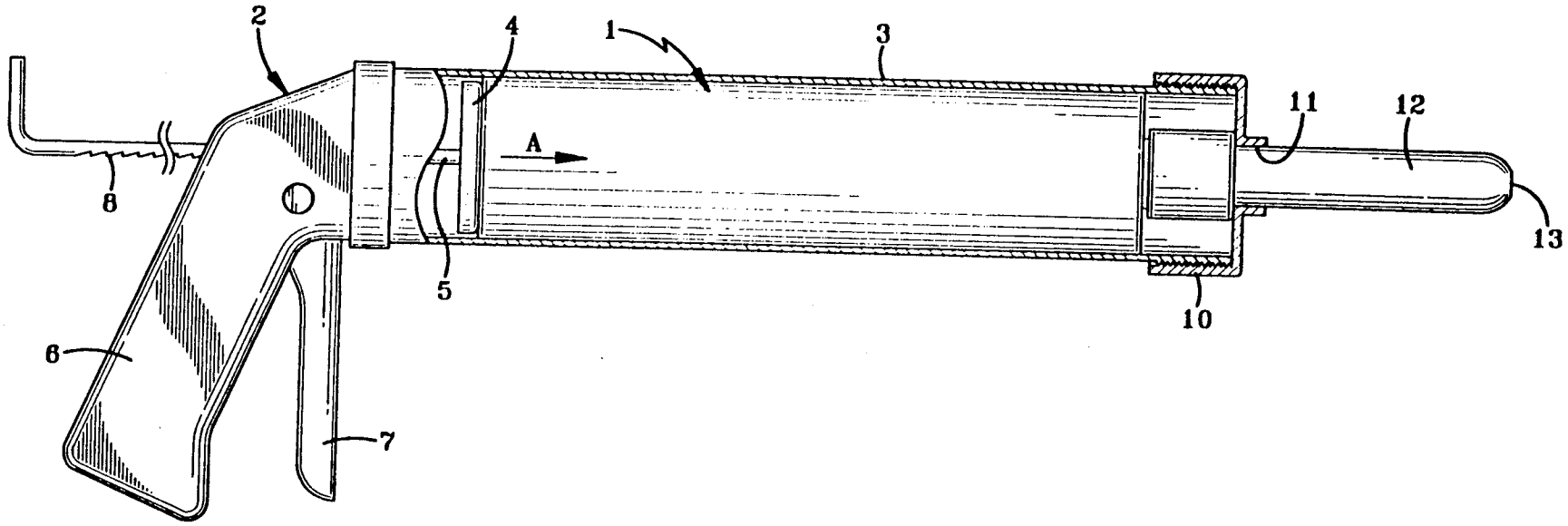
FIG. 1 is a side elevational view, portions of which are broken away and shown in section, showing the dual product dispenser mounted within a usual caulking gun.

The improved dual product dispenser of the present invention is indicated generally at 1, and is shown in FIG. 1 mounted within one type of device for exerting a dispensing force on the dispenser, which is shown as a typical caulking gun which is indicated generally at 2. Gun 2 is of a usual construction used for dispensing various types of single component caulking materials. It includes a cylindrical barrel 3, only of portion of which is shown in FIG. 1, containing a plunger 4 which is moved within the barrel by a rod 5 which extends through a handle 6 which is provided with a trigger 7. Actuation of trigger 7 advances plunger 4 in the direction of Arrow A through a predetermined distance by a well known mechanism which engages ratchet teeth 8 formed on the rear of rod 5, each time the trigger is squeezed by an operator. Dispenser 1 is loaded into barrel 3 in a usual manner and plunger 4 is advanced until it engages the rear of the dispenser whereupon the caulking gun is in position for dispensing the dual product contents of dispenser 1.

An end cap 10 preferably is removably mounted on the forward end of barrel 3 and is formed with a central end opening 11 through which a dispensing nozzle 12 is adapted to extend when dispenser 1 is mounted within the barrel. Nozzle 12 preferably contains a static mixer such as shown in U.S. Pat. No. 4,014,463, whereby the dual products upon entering the nozzle are uniformly mixed as they move through the nozzle, prior to being discharged from end opening 13 thereof.

It is readily understood that force applying mechanisms other than caulking gun 2, may be utilized with dispenser 1 without affecting the concept of the invention. For example, the linear force applied by plunger 4 required to operate the dispenser, may be applied manually, pneumatically, hydraulically, by threadedly advancing an actuating screw, or various other types of mechanisms.

Figure 2:
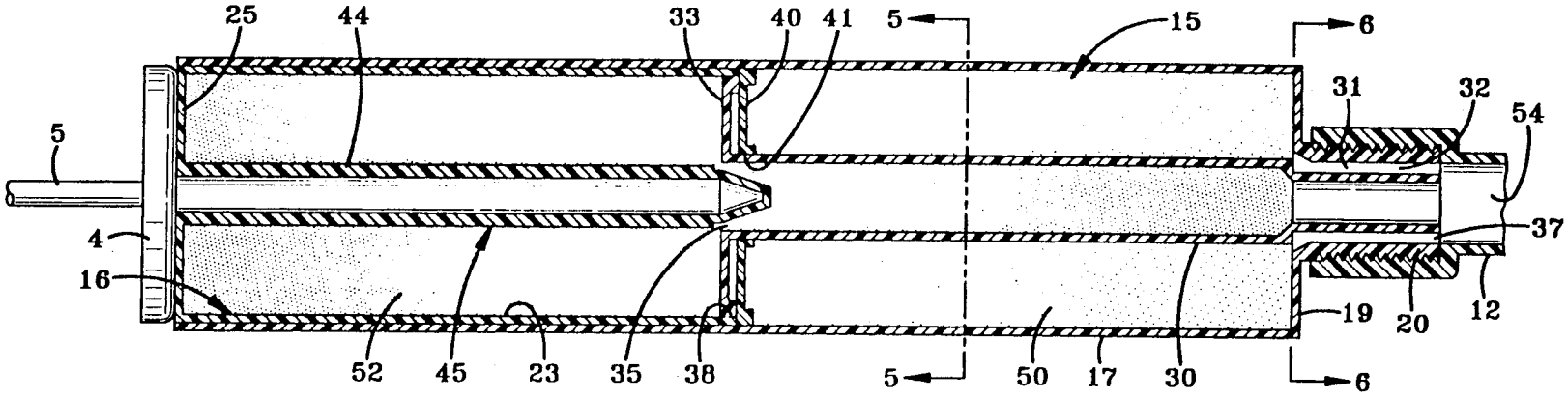
FIG. 2 is a longitudinal fragmentary sectional view of the dispenser in a completely filled position with only a portion of a dispensing nozzle shown mounted thereon.

Referring to FIGS. 2–71 dispenser 1 includes a forward chamber and an axially aligned rear chamber indicated generally at 15 and 16, respectively. Forward chamber 15 is formed by a cylindrical tubular member having a cylindrical wall 17 which extends throughout the length of dispenser 1. Wall 17 terminates in an open rear end 18 and at a front wall 19. Front wall 19 is formed with a forwardly projecting annular boss 20 having external threads onto which nozzle 12 may be threadedly engaged.

Rear chamber 16 is a tubular shaped member having a cylindrical wall 23 which is provided with an open front end 24 and a rear closure wall 25. The outside diameter of cylindrical wall 23 of rear chamber 16 is complementary to the inside diameter of cylindrical wall 17 of forward chamber 15 in order to provide a relatively tight, yet sliding, engagement therebetween, the purpose of which is discussed further below.

Figure 6:
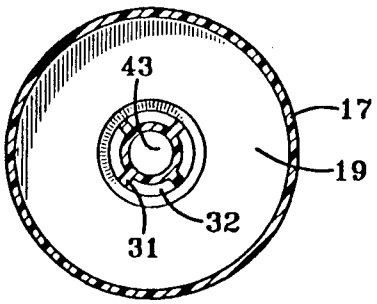
FIG. 6 is a transverse sectional view taken on line 6—6, FIG. 2.
Figure 5:
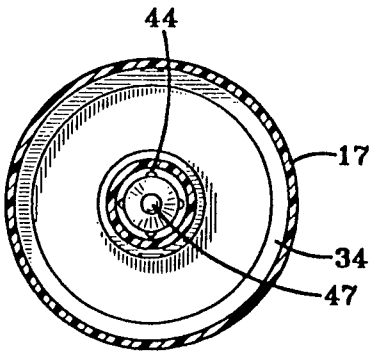
FIG. 5 is a transverse sectional view taken on line 5—5, FIG. 2.

In accordance with one of the features of the invention, a hollow cylindrically shaped delivery tube 30 is mounted within the hollow interior of forward chamber 15 by a plurality of radially extending ribs 31 (FIG. 6) which are formed integrally with a reduced diameter end 36 of tube 30.. Ribs 31 are in a force-fit-engagement with the inside surface of boss 20. Ribs 31 extend from the open end of tube 30 to front wall 19 and form a plurality of gaps 32 to permit the flow of fluid from chamber 15 through boss 20. The rear end of delivery tube 30 is formed with a disc shaped partition end wall or plate 33, which extends radially outwardly therefrom, and which forms the piston for rear chamber 16. Wall 33 terminates in an enlarged-peripheral edge 34 which is spaced from the inside surf ace of chamber wall 17 to provide an annular passage 38 through which cylindrical wall 23 of rear chamber 16 extends during operation of dispenser 1 as described below.

Wall 33 is formed with a central opening 35 which forms the open end of delivery tube 30. The reduced diameter front end 36 of delivery tube 30 extends coaxially into annular boss 20 at the front end of chamber 15, and in combination with ribs 31 form flow passages 32, which form an annular discharge port 37 for chamber 15.

An annular disc shaped piston 40 is telescopically slidably mounted within front chamber 15 on delivery tube 30 by delivery tube 30 passing through a circular central opening 41 formed in piston 40. An outer peripheral edge 42 of piston 40 is thickened slightly to provide rigidity to the piston.

Figure 3:
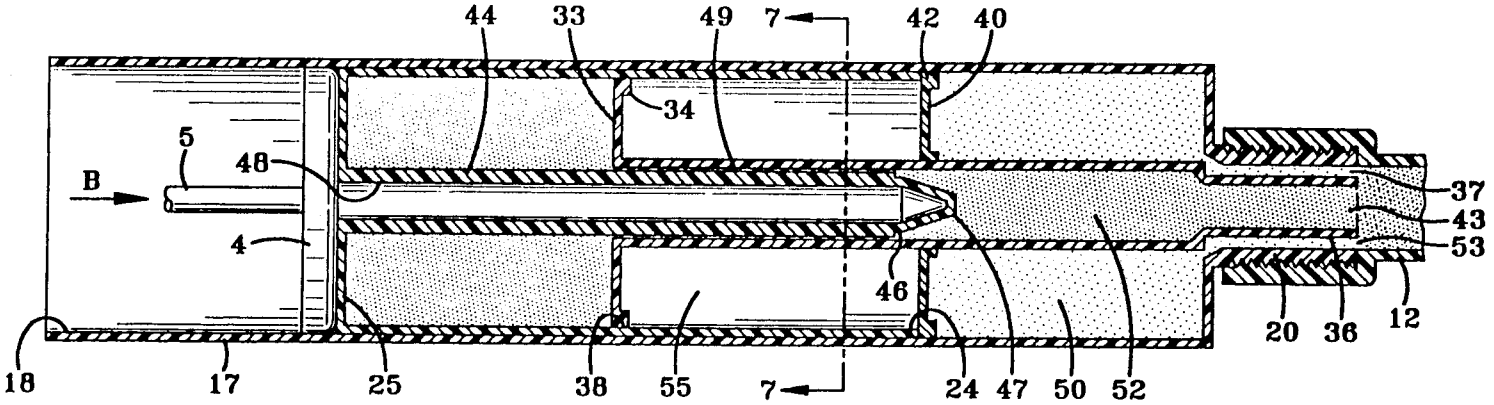
FIG. 3 is a fragmentary sectional view similar to FIG. 2 showing the position of the dispenser components in an intermediate dispensing position.
Figure 4:
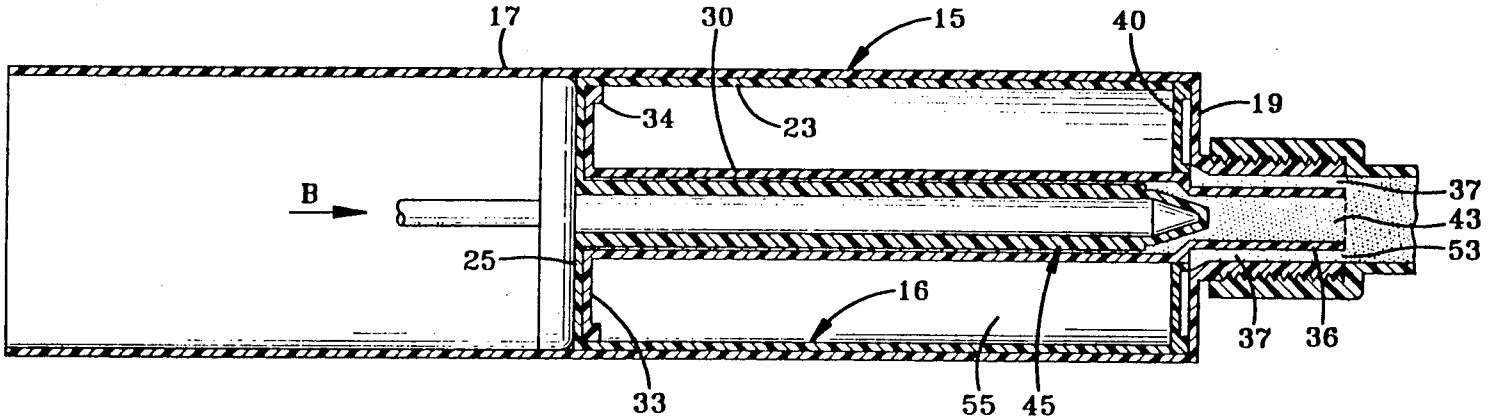
FIG. 4 is a fragmentary sectional view similar to FIGS. 2 and 3 showing the position of the dispenser components at the end of the dispensing cycle, or when in position for filling with the dual products.
Figure 7:
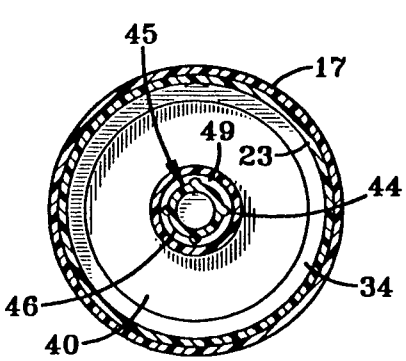
FIG. 7 is a transverse sectional view taken on line 7—7, FIG. 3.

In accordance with another feature of the invention, a post indicated generally at 45, is formed integrally with rear closure wall 25 and extends axially forwardly therefrom for subsequent telescopic movement into the interior of delivery tube 30 during the operation of dispenser 1, as shown particularly in FIGS. 3 and 4. Post 45 preferably has a generally cylindrical shape, and is formed by a wall 46 which terminates in a generally pointed closed end 47. Rear end 48 of post 45 may be open as shown in the drawings, or if desired be closed, without effecting the invention. Likewise, post 45 may be a solid member instead of hollow as shown in the drawings. A plurality of ribs 44, four of which are shown in the drawings, extend radially outwardly from post wall 46 and will be in close proximity with the inside surface of delivery tube 30 when post 45 is inserted therein as shown in FIGS. 3 and 4, in order to maintain post 45 centered within tube 30.

FIG. 2 shows dispenser 1 in a fully filled condition with front chamber 15 being filled with a fluid product 50 and rear chamber 16 including the interior of delivery tube 30, being filled with a fluid product 52. When in the filled position, piston 40 will be closely adjacent or an abutting relationship with partition wall 33, with end wall 25 of rear chamber 16, being generally aligned at open end 18 of forward chamber 15. In this filled position, front end 47 of post 45 will be located generally adjacent or partially within rear end opening 35 of delivery tube 30. Filled dispenser 1 is then placed in a mechanism for applying a discharge pressure against rear closure wall 25 of rear chamber 16, such as caulking gun 2 or other type of mechanism as discussed above. Caulking gun 2, except for plunger 4 and a portion of rod 5, is removed from FIGS. 2–7 for the sake of clarity.

To dispense dual products 50 and 52 from dispenser 1, plunger 4 is moved forwardly in the direction of Arrow B, and will telescopically slidably move rear chamber 16 within the interior of forward chamber 15 with cylindrical walls 17 and 23 being in sliding engagement with each other. As shown in FIG. 3, the diameter of plunger 4 or other force applying mechanism, is of a sufficient size to enable it to move within the interior of forward chamber wall 17.

Upon the forward movement of rear chamber 16 the annular front peripheral edge of cylindrical wall 23 will move through annular opening 38 and along the interior of outer wall 17 moving with it piston 40, as shown by comparison of FIGS. 2 and 3. Forward movement of piston 40 will force product 50 out of forward chamber 15 through annular discharge port 37 and into the hollow interior 54 of nozzle 12. Simultaneously, with the discharge of product 50, the forward movement of rear closure wall 25 by plunger 4, will force product 52 from rear chamber 16 through central opening 35 of stationary end wall 33 and along elongated annular passage 49 formed between post 45 and the interior of delivery tube 30, and out through discharge port 43 at the open end of delivery tube, where it immediately mixes at an annular area 53 with discharged product 50 of forward chamber 15. Lately upon movement of rear chamber 16, post 45 will start moving product 52 through discharge port 43 nearly simultaneously with the discharge of product 50 through discharge port 37.

Thus, the synchronous movement of piston 40 with end wall 25 and the movement of post 45 within tube 30 will result in the synchronous discharge of products 50 and 52 from their respective chambers in a predetermined relationship assuming that both chambers are filled as shown in FIG. 2 at the start of the dispensing operation.

FIG. 4 shows the position of the various dispenser components at the end of the complete discharge of the contents, at which position, piston 40 will be in contact with or closely adjacent end wall 19 of forward chamber 15, with end wall 25 of rear chamber 16 being located closely adjacent or in contact with fixed partition wall or piston 33 of front chamber 15, with post 45 extending completely into the interior of delivery tube 30.

FIG. 4, in addition to showing the position of the various components of dispenser 1 at the end of a complete discharge position, also represents the position of the various components at the time when the cartridge is ready to be filled with products 50 and 52. Post 45 will occupy most of the free volume within delivery tube 30. Without the post, the free volume at start of the filling of rear chamber 16 would be substantially greater than the free volume in front chamber 15. Having similar free volumes in each chamber helps the filling operation since both chambers can now be pressure filled simultaneously without worrying about the residual pressure due to air compression being substantially greater in one chamber than in the other.

Although the above description and drawings show the dispenser, and in particular the chambers thereof, being cylindrical and of generally equal volume, it is readily understood that the configuration of the chambers as well as the internal volume thereof, may change in order to provide a different ratio between the amounts of products being dispensed for subsequent mixing in nozzle 12. For example, forward chamber 15 may contain less volume than that of rear chamber 16 so that a smaller amount of product 50 is dispensed for mixing with a larger amount of product 52, depending upon the chemical makeup of the products and the subsequent mixed product to be formed thereby. Thus, the volume of product 52 may be greater or less than the volume of product 50 in order to achieve a desired chemical reaction between the two products and the resultant product produced thereby.

In accordance with another of the features of the invention, the relatively tight sliding engagement between cylindrical chamber walls 17 and 23 provides for the creation of a partial vacuum in an annular space 55 which is formed between piston 40 and wall 33 as piston 40 is moved forwardly into forward chamber 15. This partial vacuum will assist in drawing piston 40 back into chamber 15 upon the relaxing of the applied force, tending to create a "suck back" effect on the mixed product remaining in nozzle 12. This reduces weeping or unwanted dripping of the mixed product from nozzle opening 13.

Heretofore in prior art dispensers such as shown in Pat. Nos. 4,029,236 and 4,220,261, positive structure had to be added or incorporated in the dispenser to vent this free space which is created upon the relative movement of the pistons. The creation of this partial vacuum in annular space 55 will not be burdensome since for most applications for which dispenser 1 will be utilized, the applying dispensing force of plunger 4 or similar mechanism, will be relatively large to overcome this partial vacuum and the large frictional force created by of the products moving through the static mixer or similar discharge nozzle 12. The applied force will be of a magnitude sufficiently greater than the force created by the partial vacuum and friction thereby adding no ill effect on the operation of the device, yet providing an advantage by reducing the unwanted dripping or weeping of the product through nozzle opening 13 upon removal of the dispensing force.

Thus, dispenser 1 provides an improved dual product dispenser which can be mass produced in relatively large quantities relatively inexpensively, preferably by molding the various components of plastic materials, which components can then be assembled rapidly with a minimum of manufacturing operation and fabrication enabling the dispenser to be a throwaway item. Also the various plastic materials can be chosen as to avoid reaction with the fluid products in contact therewith. However if desired, the dispenser can be cleaned of remaining fluid products for subsequent refilling for certain applications. Likewise, dispenser 1 as discussed above, is adapted for easy filling, again adding to the reduced cost of the filled dispenser.

Accordingly, the improved dual product dispenser is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved dual product dispenser is constructed and used, the characteristics of the construction, and the advantageous, new and useful results obtained; the new and useful structures, devices, elements, arrangements, parts and combinations, are set forth in the appended claims.

We claim:

1. A dual product dispenser including:

first and second chambers having hollow interiors, each of said chambers having a piston for discharging a first and a second product respectively, from the interiors of said chambers; said second chamber being slidably mounted within the interior of the first chamber wherein movement of the second chamber effects synchronous movement of both pistons with respect to their respective chambers for discharging the products therefrom; each of said chambers having an exit port through which the respective products are discharged upon movement of the second chamber into the first chamber; a product delivery tube extending through the interior of the first chamber, said delivery tube having a first open end communicating with the interior of the second chamber and a second open end providing the exit port for said second chamber; and an elongated post mounted on the second chamber moveable into the delivery tube of the first chamber upon movement of the second chamber into said first chamber.

2. A dispenser as defined in claim 1 in which a mixer nozzle communicates with the exit ports of the first and second chambers for receiving first and second products upon discharge from the respective chambers.

3. A dispenser as defined in claim 1 in which each of the chambers has an elongated cylindrical outer wall; and in which said walls are in sliding contact engagement with each other.

4. A dispenser as defined in claim 3 in which the second chamber piston is fixedly mounted on the delivery tube adjacent the first end thereof and extends transversely across the interior of the first and second chambers to form a partition therebetween.

5. A dispenser as defined in claim 4 in which an outer edge of the second chamber piston forms an annular opening with the cylindrical wall of the first chamber; and in which a free end of the second chamber wall extends through said annular opening and engages the piston of the first chamber for moving said first chamber piston into the first chamber to discharge a first product therefrom.

6. A dispenser as defined in claim 3 in which the second chamber has a rear wall; and in which the post is mounted on said rear wall and extends outwardly forwardly from a center thereof.

7. A dispenser as defined in claim 6 in which the post is hollow and is formed integrally with the end wall of the second chamber.

8. A dispenser as defined in claim 6 in which the post has a front end; and in which said front end is located within the first open end of the delivery tube when the second chamber is in a fully retracted filled condition.

9. A dispenser as defined in claim 3 in which the first piston is a disc-shaped plate formed with a central opening through which the delivery tube extends; and in which said delivery tube forms a sliding fit with said first piston.

10. A dispenser as defined in claim 3 in which an annular space is formed between the pistons as the second chamber moves within the first chamber; and in which the sliding contact engagement between the chamber walls results in a partial vacuum being formed in said annular space.

11. A dispenser as defined in claim 8 in which the front end of the post is located adjacent an outlet end of the delivery tube when the second chamber reaches the end of its movement within the first chamber.

12. A dispenser as defined in claim 1 in which the elongated post forms an annular space within the delivery tube when moved therein through which the second product moves when being forced from the second chamber.

13. A dispenser as defined in claim 1 in which the exit ports of the first and second chambers are coaxial with respect to each other.

* * * * *